United States Patent [19]

Sasaki

[11] 4,023,161

[45] May 10, 1977

[54] KEY DEVICE FOR PRODUCING BINARY CODES

[76] Inventor: Makoto Sasaki, 1700-18, Bukko-cho, Hodogaya, Yokohama, Japan

[22] Filed: June 3, 1976

[21] Appl. No.: 692,562

[30] Foreign Application Priority Data

June 3, 1975 Japan ..... 50-66802
Oct. 4, 1975 Japan ..... 50-135778[U]

[52] U.S. Cl. ..... 340/365 R; 200/42 R; 340/149 A; 340/274 C; 361/171

[51] Int. Cl.[2] ..... G08C 1/00; H01H 27/00

[58] Field of Search ..... 340/365 R; 200/42 R; 317/134

[56] References Cited

UNITED STATES PATENTS 2,868,905 1/1959 Meyer ..... 200/42 R
3,824,354 7/1974 Anderson ..... 340/365 R

*Primary Examiner*—Thomas B. Habecker

[57] ABSTRACT

A key device for producing binary codes, wherein an output shaft is rotated by any of separately provided keys in sliding contact with the inner wall of a hole penetrating an outer casing; a plurality of push pin assemblies are provided; a plurality of switch means are arranged each corresponding to each push pin assembly; there are separately provided a plurality of keys for rotating an output shaft, each of which has longer and shorter grooves to push each push pin assembly; each push pin assembly normally locks the output shaft to the outer casing; each push pin assembly is formed of at least first, second and third linearly arranged unit pins; when pushed by either or both of the longer grooves and shorter grooves, each push pin assembly unlocks the output shaft for rotation; when the output shaft is rotated through a prescribed angle, each push pin assembly selectively operates the corresponding switch means according to the lengths of the longer and shorter grooves by which said push pin assembly is pushed, thereby producing a binary code exclusively represented by a key used.

3 Claims, 12 Drawing Figures

FIG. 7
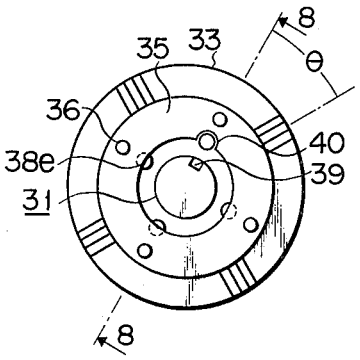
FIG. 9
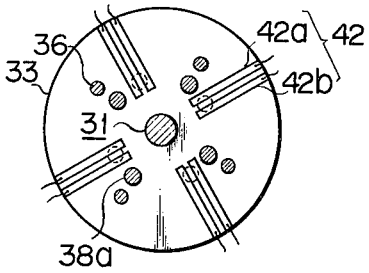
FIG. 10
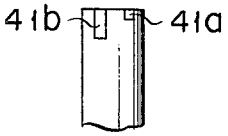
FIG. 8
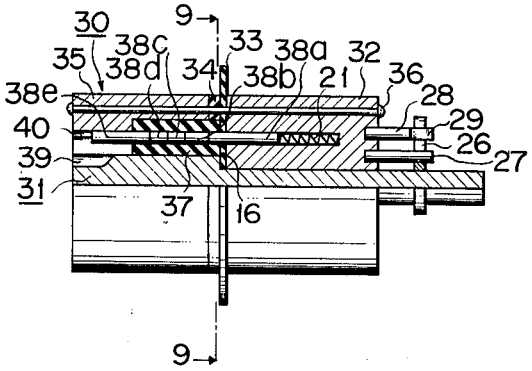
FIG. 11
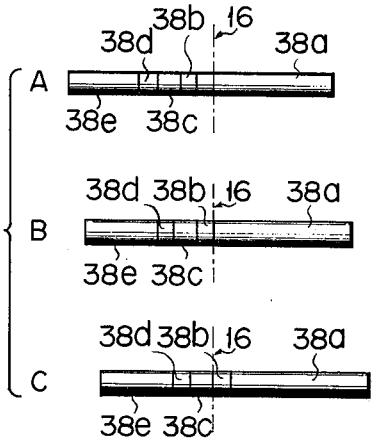
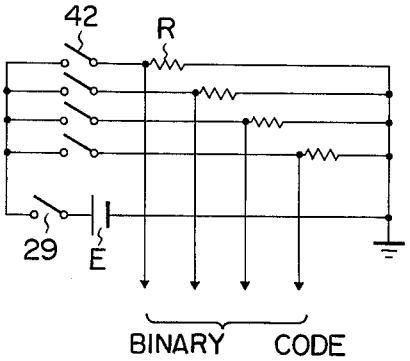
FIG. 12

KEY DEVICE FOR PRODUCING BINARY CODES

BACKGROUND OF THE INVENTION

This invention relates to a key device for producing binary codes. At present, the respective parts or sections of apparatuses such as registers, minicomputers and data writers are placed in charge of operators holding exclusive keys for said respective parts or sections. Thus, these parts or sections can not be operated by any other person than the holders of said exclusive keys. This arrangement is naturally required for supervision of operators and prevention of disclosure of information. A key device intended for this object is preferred to produce binary codes related to, for example, the mechanical release of the prescribed parts or sections of an electronic apparatus and the operation of a power source. Such a key device is generally provided with an output shaft normally locked to the outer casing of said device. Key operation by a key holder unlocks the output shaft. The resultant rotation of the output shaft effects the actuation of a power source or the release of external machines or apparatuses. However, a binary code-generating key device which allows an output shaft to be rotated through a prescribed angle when disengaged from the outer casing by key operation is demanded to produce a considerably larger number of (for example, 256) binary codes exclusively represented by the corresponding number of keys differently designed for use with said key device. Though issue of 256 binary codes can be effected by selective operation of eight switches, a very difficult problem has been encountered in combining a mechanism for unlocking the key device and a mechanism for selectively operating, for example, eight switches in said key device which is desired to be compact. To date, therefore, no satisfactory binary code-generating key device has been developed. There has hitherto been proposed a binary code-generating key device which has a plurality of lock ports and a plurality of switches linearly arranged behind the lock ports and is designed to issue a binary code upon insertion of a key into the corresponding lock port. However, this prior art key device has the drawbacks that the key device itself becomes bulky; key operation requires a force and tends to be unstable; and only 30 to 60 binary codes can be produced by keys, no matter how varied they are in design.

It is accordingly the object of this invention to provide a binary code-generating key device which can produce a large number of binary codes by a simple arrangement and in consequence is made very compact.

SUMMARY OF THE INVENTION

A binary code-generating key device according to this invention comprises an outer casing defined into first and second concentric sections by a dividing plane perpendicular to the axis of the casing, the first section being provided with a penetrating hole of smaller inner diameter and the second section being bored with a penetrating hole of larger inner diameter; an output shaft whose shoulder portion extends along the dividing plane and which can slide on the inner walls of the penetrating holes; a plurality of switch means fixed to the outer casing so as to concentrically arranged with the output shaft; a plurality of push pin assemblies provided in a number corresponding to the plural switch means, each of the push pin assemblies penetrating the shoulder portion of the output shaft parallel with the axis of said output shaft with part of said push pin assembly slidably inserted into the first section of the outer casing, thereby normally locking the output shaft to the outer casing; a plurality of keys each being capable of transmitting the rotation of the key to the output shaft and provided with a plurality of longer and shorter grooves for inserting part of each push pin assembly into the first smaller diameter section of the outer casing, wherein each push pin assembly is formed of at least first, second and third linearly arranged unit pins, and, when inserted according to the key groove length, unlocks the output shaft from the outer casing to rotate said shaft through a prescribed angle for selective operation of the switch means, thereby generating a binary code exclusively represented by a key used.

BRIEF DESCRIPTION OF THE DRAWING

FIG. 7 is a top view of a binary code-generating key device according to another embodiment of the invention;

FIG. 8 is a fructional cross sectional view on line 8—8 of FIG. 7;

FIG. 9 is a cross sectional view on line 9—9 of FIG. 8;

FIG. 10 is a side elevation of one of the keys used with the binary code-generating key device of FIG. 8;

FIG. 11 sets forth the positions of the push pin assembly of FIG. 8 relative to the locked and unlocked positions of the output shaft: A shows the locked position of the output shaft, B indicates the unlocked condition of the output shaft and the inoperative condition of the switch, and C presents the unlocked condition of the output shaft and the operative condition of the switch; and FIG. 12 shows the electric connection of the switches of FIG. 9.

DETAILED DESCRIPTION OF THE PREFERRED EMBODIMENT

Figure 1:
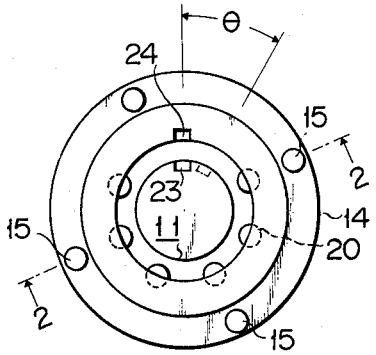
FIG. 1 is a top view of a binary code-generating key device according to an embodiment of this invention.
Figure 2:
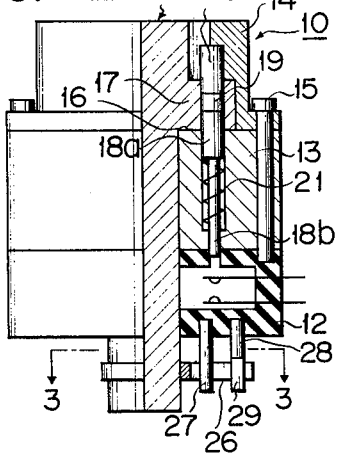
FIG. 2 is a fractional cross sectional view on line 2—2 of FIG. 1.
Figure 5:
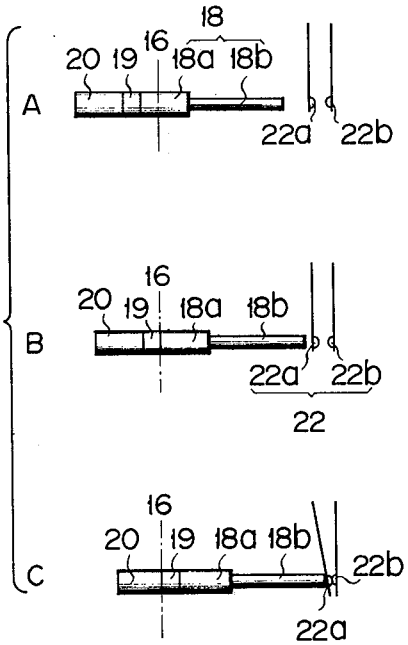
FIG. 5 shows the relative positions of the push pin assembly and corresponding switch of FIG. 2: A shows the locked condition of the output shaft, B indicates the unlocked condition of the output shaft and the inoperative condition of the switch, and C illustrates the unlocked condition of the output shaft and the operative condition of the switch.

Referring to FIG. 2, a cylindrical key comprises an outer casing 10 and an output shaft 11. The outer casing 10 consists of a hollow cylindrical insulation member 12 and hollow cylindrical metal members 13, 14, all coupled together by four pins 15. The assembly is defined by a dividing plane 16 into a first section provided with a penetrating hole of smaller inner diameter and a second section bored with a penetrating hole of larger inner diameter. The output shaft 11 whose shoulder portion 17 slidably extends along the dividing plane 16 is rotated in slidable abutment against the inner walls of the penetrating holes of smaller and larger inner diameters. First, second and third unit pins 18, 19, 20 are linearly arranged and penetrate the shoulder portion 17 of the output shaft 11 so as to slide parallel with the axis of said shaft 11. The unit pin 18 is formed of a portion 18*a* and insulating portion 18*b* and slides through the first smaller diameter section. The portion 18*a* normally takes a position shown in FIG. 2 by the action of a spring 21 to lock the output shaft 11 to the outer casing 10. A switch 22 (FIG. 5) consisting of a movable contact 22*a* and stationary contact 22*b* is positioned below the extension line of the assembly of the linearly arranged three unit pins. A lead of the switch 22 is drawn out of the outer casing 10.

Figure 3:
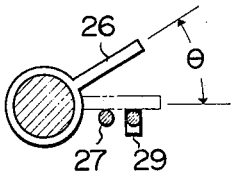
FIG. 3 is a cross sectional view on line 3—3 of FIG. 2.
Figure 4:
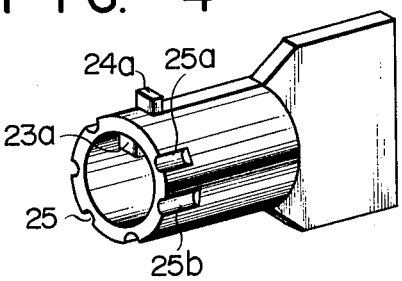
FIG. 4 is an oblique view of one of the keys used with the binary code-generating key device of FIG. 2.
Figure 6:
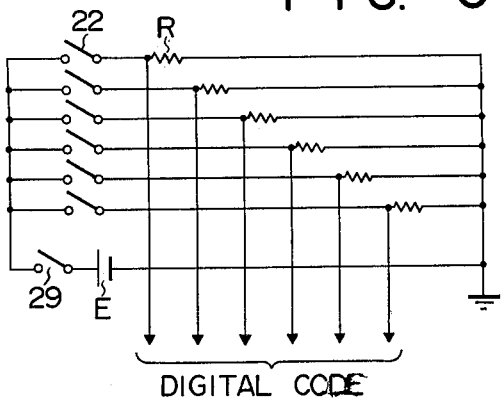
FIG. 6 shows the electrical connection of the respective switches of FIG. 2.

FIG. 4 illustrates one of the keys used with a binary code-generating key device according to an embodiment of this invention. This key is provided with a projection 23*a* fitted into a keyway 23 of the output shaft 11 and a projection 24*a* fitted into a key port 24 of the outer casing 10 when the key is inserted into the output shaft 11. As shown in FIG. 4, the key has six axially extending six grooves 25 formed in the peripheral surface. When the key is inserted into the output shaft 11, the grooves 25 push the push pin assembly toward the switch 22, with the projection 24*a* fitted into the key port 24. The number and arrangement of the shorter grooves 25*a* and longer grooves 25*b* are so determined as to generate a binary code exclusively represented by a key used. The second unit pin 19 has a length chosen to be at least equal to a distance between the movable contact 22*a* and stationary contact 22*b*. An extension of the output shaft 11 is provided with a lever 26. When the output shaft 11 is rotated, for example, clockwise through an angle of $\theta$ by the key of FIG. 4, then the lever 26 causes the rotation of the output shaft 11 to be stopped by a stopper 27 fixed to the hollow cylindrical insulating material 12. When the output shaft 11 is brought to rest, a microswitch 29 mounted on a stationary shaft 28 is put into operation (FIG. 3). A binary code-generating circuit including the switches 22, microswitch 29, power source E and resistors R is illustrated in FIG. 6.

There will now be described the operation of the foregoing embodiment. When the key is inserted into the output shaft 11 with the projection 24*a* of the key (FIG. 4) fitted into the key port 24 of the outer casing 10, then the top portion of the push pin assembly locked up to this point as shown in FIG. 5A is inserted into either the shorter groove 25*a* or the longer groove 25*b* formed in the periphery of the key. Since both shorter and longer grooves have a predetermined length, the boundary between the pin 18*a* and pin 19 of the push pin assembly pushed by the longer groove 25*b* is aligned, as shown in FIG. 5B, with the dividing plane 16 to unlock the output shaft 11. In this case, however, the pin 18*b* does not actuate the switch 22. When the push pin assembly is pushed by the shorter groove 25*a*, then the boundary between the pins 19, 20 falls on the dividing plane 16 as shown in FIG. 5B, unlocking the output shaft 11 and energizing the switch 22. Since the pin 19 has a length chosen to be at least equal to a distance between the movable contact 22*a* and stationary contact 22*b* of the switch 22, namely, determined in consideration of the possible overtravel of the movable contact 22*a*, complete contact is attained between the movable and stationary contacts 22*a*, 22*b*. In the above-mentioned stage of operation, the microswitch 29 still remains inoperative, preventing the issue of a binary code. When the output shaft 11 is rotated clockwise through an angle of $\theta$, then the pin 18 or both pins 18, 19 retain the original positions on the outer casing 10 and the microswitch 29 is closed, producing a binary code corresponding to the key used. Namely, selective operation of the six switches is effected according to the manner in which the shorter and longer grooves 25*a*, 25*b* are combined, thus making it possible to generate $2^6=64$ binary codes. If push pin assemblies, switches and grooves are provided in a number of 8 alike, then it will be possible to produce 256 binary codes or 100 binary coded decimal (BCD) codes.

With the foregoing embodiment, the stopper 27 and microswitch 29 may be set inside of the outer casing 10. The switch 22 is not limited to the indicated type, but may be of any other type, provided it can be actuated when contacted by the pin 18*b*. It is further possible to operate a power source other than the power source E of FIG. 6 by fitting, for example, a rotary switch to the lower part of the output shaft 11 of FIG. 2.

There will now be described by reference to FIGS. 7 to 12 a binary code-generating key device according to another embodiment of this invention. The cylindrical lock of FIG. 8 comprises an outer casing 30 and output shaft 31. The outer casing 30 consists of a hollow cylindrical member 32, later described insulation board 33, washer-shaped insulation board 34 and another hollow cylindrical member 35 all coupled together by four revets 36. The assembly is defined by a dividing plane 16 into a first section provided with a penetrating hole of smaller inner diameter and a second section bored with a penetrating hole of larger inner diameter. The output shaft 31 has an insulating shoulder portion 37 slidably extending along the dividing plane 16. Said shoulder portion 37 of the output shaft 31 slidably contacts the inner wall of the larger diameter penetrating hole of the second section, and the other portion of the output shaft 31 is rotated in slidable contact with the inner wall of the smaller diameter penetrating hole of the first section. Four push pin assemblies 38 each formed of first (38*a*), second (38*b*) (made of insulating material), third (38*c*) (made of metal), fourth (38*d*) (made of insulating material) and fifth (38) (made of any optional material) unit pins all linearly arranged penetrate the shoulder portion 37 of the output shaft 31 so as to slide parallel with the axis of said output shaft 31. Part of the first pin 38*a* is slidably inserted into the wall of the hollow cylindrical member 32 normally to lock the output shaft 31 to the outer casing 31 by occupying the indicated position through the action of a spring 21. FIG. 10 is a fractional side elevation of a key used with the cylindrical lock of FIG. 8. The key has a projection (not shown) fitted into a groove 39 designed for the rotation of the output shaft 31 and another projection (not shown) engaging a key groove 40 formed in the inner periphery of the outer casing 30. The periphery of the key shown in FIG. 10 is provided with shorter grooves 41*a* and longer grooves 41*b* in a total number of 4. These grooves 41*a*, 41*b* are used to push the push pin assembly 38 when the key is inserted into the output shaft. The arrangement of the shorter and longer grooves 41*a*, 41*b* is so determined as to cause the key to produce an exclusive binary code. Four switches 42 each formed of two metal pieces 42*a*, 42*b* provided, for example, by print technique are mounted on the insulation board 33. These four switches are arranged, as shown in FIGS. 7 and 9, at an equal peripheral distance respectively at a point clockwise spaced by an angle of $\theta$ from the corresponding key ports of the outer casing. When the output shaft is unlocked and the metal pieces 42*a*, 42*b* of FIG. 9 are short-circuited by a metal pin at a point indicated in a dotted line (FIG. 9), then the switch 42 is rendered conducting. When short-circuited by an insulation pin, the switch 42 becomes inoperative. That end of the output shaft 31 which faces the hollow cylindrical member 32 is fitted with a lever 26. When the output shaft 31 is rotated clockwise by an angle of $\theta$ from the key groove 40, then the lever 26 causes the rotation of the output shaft 31 to be stopped by the stopper 27. At this time, the microswitch 29 fitted to the stationary shaft 28 is actuated. A binary code-generating circuit including the switches 42, microswitch 29, power source E and resistor R is illustrated in FIG. 12.

There will now be described by reference to FIGS. 7 to 12 the operation of the second embodiment of this invention. The line 8—8 of FIG. 7 shows that position on the cylindrical lock in which the output shaft 31 is unlocked by the key. The key is so inserted into the output shaft 31 as to fit with said position. FIG. 11A shows the position of the push pin assembly when the output shaft 31 is locked.

Since the pin 38*a* is placed in the cylindrical lock in contact with both outer casing 30 and output shaft 31, the output shaft 31 remains locked. When pushed by the longer groove 41*b* of the inserted key, the push pin assembly is so designed that the boundary between the first pin 38*a* and second pin 38*b* falls, as shown in FIG. 11B, on the dividing plane 16 to unlock the output shaft. When the push pin assembly is pushed by the shorter groove 41*a* of the inserted key, the push pin assembly is so designed that the boundary of the second pin 38*b* and third pin 38*c* is aligned, as shown in FIG. 11*c*, with the dividing plane 16 to unlock the output shaft. When the output shaft 31 is rotated, as shown in FIG. 7, clockwise by an angle of $\theta$ under an unlocked condition, then one of the unit pins inserted into the shoulder portion of the output shaft 31 occupies, as shown in FIG. 9, such a position as to short-circuit the metal pieces 42*a*, 42*b*. When the push pin assembly 38 is pushed by the longer groove 41*b*, then the corresponding metal pieces 42*a*, 42*b* are short-circuited by the second insulating pin 38*b* (FIG. 11B) to render the switch 42 inoperative. When the push pin assembly 38 is pushed by the shorter groove 41*a*, then the corresponding metal pieces 42*a*, 42*b* are short-circuited by the third metal pin 38*c* to operate the switch 42. When rotated clockwise by an angle of $\theta$, then the output shaft 31 is prevented from making any further rotation by the stopper 27. Since the microswitch 29 is energized at this time, a 4-bit binary code is generated.

The bit number of a binary code is obviously determined by the number of push pin assemblies 38 and switches 42. The switch 42 is not restrictively chosen to be formed of printed wire, but may be of any other type, provided it is rendered nonconducting when contacted by an insulating pin and becomes operative when contacted by a conducting pin. The object for which the fourth pin 38*d* is made of insulating material is to prevent the occurrence of electrical connection between the switches 42. With the second embodiment of this invention, the stopper 27 and microswitch 29, for example, may be received in the outer casing. Further, it is possible to operate a power source other than the binary code-generating power source E by fitting a rotary switch to the output shaft 31. Where comparison is made between a code signal issued by the device of this invention and a preset code signal and, an arrangement is made for an external apparatus to be unlocked upon coincidence between both code signals, then said preset code signal can be changed as often as desired. Under such arrangement, it is possible to manufacture an electronic lock which prevents the external apparatus from being operated, unless a code signal generated by a key used coincides with a preset code signal thus frequently changed. Further, the electronic lock of the this invention consumes power only when the output shaft is unlocked, offering greater economic advantage than any other electronic lock.

What is claimed is:

1. A binary code-generating key device which comprises an outer casing defined by a dividing plane perpendicular to the axis of said casing into a first section provided with a penetrating hole of smaller inner diameter and a second section bored with a penetrating hole of larger inner diameter; an output shaft whose shoulder portion extends along the dividing plane and which can slide through said penetrating holes; a plurality of switch means fixed to the outer casing concentrically with the output shaft; a plurality of push pin assemblies provided in a number corresponding the plurality switch means and each formed of at least linearly arranged first, second and third unit pins, said push pin assembly slidably penetrating the shoulder portion of the output shaft parallel with the axis of said output shaft with part of said assembly slidably inserted into the first section of the outer casing thereby normally to lock the output shaft to the outer casing, and, when pushed, unlocking the output shaft for selective operation of the plural switch means; a plurality of keys each being capable of transmitting the rotation of the key to the output shaft and provided with a plurality of longer and shorter grooves, pushing part of the push pin assembly into the first section of the outer casing, and unlocking the output shaft for selective operation of the plural switch means; and means for generating a binary code exclusively represented by each key when the output shaft is rotated through a prescribed angle.

2. The binary code-generating key device according to claim 1, wherein the switch means comprises a movable contact and stationary contact received in the first section of the outer casing in the state separated from each other at a prescribed interval in the axial direction of the output shaft; the push pin assembly is formed of first, second and third unit pins with the second pin chosen to have such a length as is at least equal to the interval between the movable and stationary contacts of the switch means, the length of said push pin assembly being so chosen that when the push pin assembly is pushed by engagement with the longer grooves, the boundary between the first and second unit pins of said assembly falls on the dividing plane to unlock the output shaft from the outer casing, with the switch means corresponding to the first unit pin kept inoperative by the free end of said first unit pin, and when the push pin assembly is pushed by engagement with the shorter grooves, the boundary between the second and third unit pins of said assembly is aligned with the dividing plane to unlock the output shaft from the outer casing, with the switch means corresponding to the first unit pin rendered conducting by the free end of said first unit pin.

3. The binary code-generating key device according to claim 1, wherein the dividing plane is defined by that portion of the surface of an insulation board fixed to the outer casing which slidably contacts the shoulder portion of the output shaft, said insulation board being positioned perpendicularly to the axis of the output shaft between said first and second sections of the outer casing; the shoulder portion of the output shaft is formed of insulating material; the switch means is formed of two contacts spatially provided on the dividing plane and drawn out of the outer casing in an insulated condition; and the push pin assembly is formed of first to fifth unit pins linearly arranged, the free end of the fifth unit pin being disposed at a point engageable with the key grooves, and the second and fourth unit pins being made of insulating material; the length of said push pin assembly being so chosen that when the push pin assembly is pushed by engagement with the longer grooves of each key, the boundary between the first and second unit pins falls on the dividing plane to unlock the output shaft, when the output shaft is rotated through a prescribed angle, the two contacts are short circuited by the second unit pin made of insulating material to render the corresponding switch means nonconducting, and when the push pin assembly is pushed by engagement with the shorter grooves of the key, the boundary between the second and third unit pins is aligned with the dividing plane to unlock the output shaft, when the output shaft is rotated through the prescribed angle, the two contacts are short-circuited by the third metal unit pin to render the corresponding switch means conducting.

* * * * *